US008927886B2

(12) United States Patent
Albrecht et al.

(10) Patent No.: US 8,927,886 B2
(45) Date of Patent: Jan. 6, 2015

(54) LOAD TRANSFER SWITCH FOR A TAP CHANGER

(75) Inventors: Wolfgang Albrecht, Wenzenbach (DE); Claudia Dobler, Birkenhoehe/Maxhuette-Haidorf (DE); Klaus Hoepfl, Maxhuette-Haidhof (DE); Martin Jatta, Barbing (DE); Christian Kotz, Schorndorf (DE); Sebastian Rehkopf, Regensburg (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 218 days.

(21) Appl. No.: 13/642,130

(22) PCT Filed: Feb. 26, 2011

(86) PCT No.: PCT/EP2011/000950

§ 371 (c)(1),
(2), (4) Date: Dec. 6, 2012

(87) PCT Pub. No.: WO2011/141082

PCT Pub. Date: Nov. 17, 2011

(65) Prior Publication Data

US 2013/0112541 A1 May 9, 2013

(30) Foreign Application Priority Data

May 11, 2010 (DE) ..... 10 2010 020 180

(51) Int. Cl.

| | |
|---|---|
| ***H01H 19/00*** | (2006.01) |
| ***H01H 21/00*** | (2006.01) |
| ***H01H 9/00*** | (2006.01) |

(52) U.S. Cl.

CPC ..... *H01H 9/0016* (2013.01); *H01H 9/0027* (2013.01)

USPC ..... 200/11 TC

(58) Field of Classification Search

USPC .... 200/11 TC, 564, 11 K, 11 A, 14, 336, 1 V

See application file for complete search history.

(56) References Cited

U.S. PATENT DOCUMENTS

| | | | | |
|---|---|---|---|---|
| 3,485,965 | A * | 12/1969 | Bleibtreu et al. | 200/11 TW |
| 6,008,456 | A | 12/1999 | Pillmeier | |
| 6,998,547 | B2 | 2/2006 | Kloth | |
| 7,942,073 | B2 | 5/2011 | Jonsson | |
| 8,191,444 | B2 * | 6/2012 | Von Allmen et al. | 74/650 |
| 2013/0192963 | A1 * | 8/2013 | Hoepel et al. | 200/11 TC |

* cited by examiner

*Primary Examiner* — Renee Luebke
*Assistant Examiner* — Lheiren Mae A Caroc
(74) *Attorney, Agent, or Firm* — Andrew Wilford

(57) ABSTRACT

The present invention relates to a load transfer switch for a tap changer, comprising permanent main contacts that switch powerlessly for each phase. The general inventive concept lies in connecting the fixed permanent main contacts of side A or B of the load transfer switch by means of a movable rail-shaped permanent main contact that establishes an electrical connection to the corresponding permanent main contacts of the load line only in the end positions of the movable rail-shaped permanent main contact and in addition only provides for a single deflection for actuation, which connects in a purely compressive manner the plurality of contact fins of the corresponding fixed permanent main contact, which contact fins are connected in a resilient, articulated manner.

4 Claims, 4 Drawing Sheets

LOAD TRANSFER SWITCH FOR A TAP CHANGER

CROSS REFERENCE TO RELATED APPLICATIONS

This application is the US-national stage of PCT application PCT/EP2011/000950 filed 26 Feb. 2011, published 17 Nov. 2011 as WO2011/141082, and claiming the priority of German patent application 102010020180.4 itself filed 11 May 2010.

FIELD OF THE INVENTION

The invention relates to a load changeover switch for a tap changer with permanent main contacts switching powerlessly for each phase.

BACKGROUND OF THE INVENTION

It is long-standing state of the art to provide at load changeover switches of tapped transformers two permanent contacts which in stationary operation conduct the permanent current of the is respectively connected side A or B of the load changeover switch and thus unload the actual switching contacts of the load changeover switch. At the start of each changeover process, i.e. each actuation of the load changeover switch, the permanent main contact previously conducting the current opens first and the current is commutated to the switch contacts of the load changeover switch; after the conclusion of the entire load changeover process the other permanent main contact then closes and takes over the permanent current again.

A constructive embodiment of a load changeover switch according to category with permanent main contacts switching electrically powerlessly for each phase is known from DE 103 12 176 B3, wherein each of the permanent main contact pairs has a common electrically conductive permanent main contact which is pivotable into two different end settings and thus alternatively bridges over the respective permanent main contact pairs in stationary operation. Arranged for this purpose in the interior of the load changeover switch is a centrally extending switching shaft by which the movable electrically conductive permanent main contact constructed as a bridging contact is actuatable. Each permanent main contact pair consists of a first permanent main contact and a second permanent main contact, which are electrically insulated from one another. One of these first permanent main contacts is electrically connected with a side A and the other one of these permanent main contacts is electrically connected with the other side B of the load changeover switch. The two second permanent main contacts are permanently connected with a common load shunt of the load changeover switch, since the run-up surfaces of the pivotable permanent main contact are spherically dimensioned in such a manner that on pivoting of the permanent main contact about its bearing they remain constantly in contact with the two second permanent main contacts of the two permanent main contact pairs, which are electrically connected with the load shunt; this takes place in the form of a sliding or rolling motion. Thus, there is thereby a permanent electrical connection of the movable permanent main contact with the load shunt regardless of the setting of the movable permanent main contact. By contrast thereto, the two contact surfaces, which are respectively arranged thereunder, of the movable permanent main contact are so constructed that they come into contact with the respectively corresponding fixed first permanent main contacts only on pivoting of the movable permanent main contact into one of its two end positions.

The actuation of the movable permanent main contact takes place through an actuating strap which has a guide in the form of a slot and is articulated by fastening means. Running in the guide is an actuating pin of a deflecting crank which in turn is mounted to be rotatable about a fulcrum. The deflecting crank has at the free and thereof a profile consisting of roller engagements as well as a blocking profile disposed therebetween.

Thus, in DE 103 12 176 B3 two crank drives connected one behind the other are functionally necessary for the permanent main contact actuation, which drives due to the construction can be subject to tolerances and in addition manage guidance of the deflecting crank during the actual changeover process purely by way of an only small circular sector of a frictional blocking profile provided at the end face of the drive disk.

OBJECT OF THE INVENTION

It is accordingly the object of the present invention to indicate a load changeover switch for a tapped transformer in which the permanent main contact pairings have an increased dielectric voltage strength between the individual voltage-carrying components, with at the same time a mechanically simplified construction.

SUMMARY OF THE INVENTION

This object is fulfilled by a load changeover switch for a tap charger according to the invention.

The general inventive idea consists in connecting the fixed permanent main contacts of side A or B of the load changeover switch by means of a movable rail-shaped permanent main contact which produces an electrical connection with the respectively corresponding permanent main contacts of the load shunt only in its respective end positions and, in addition, provides only a single deflection for actuation, which connects the respective resiliently articulated multiple contact blades of the corresponding fixed permanent main contact purely by pressure. Thus, the load shunt is not electrically connected, as in accordance with the prior art, during the complete changeover process by way of at least one sub-region of the pivotably movable permanent main contact with this, but only in the respective end positions of the changeover. The physical spacings between the current-carrying components, is particularly the spacing between the run-up surfaces of the movable permanent main contact and the contact blades of the corresponding fixed permanent main contact of the respectively unconnected side, substantially increase in stationary operation due to the movable permanent main contact of rail-shaped construction, since by comparison with the prior art this can be constructed to be narrower and thus has a greater voltage strength between the voltage-carrying components.

According to the invention the movable rail-shaped permanent main contact is actuatable, i.e. pivotable, by way of only a single deflection. Provided for this purpose is a drive disk which consists of two individual disks and which has roller engagements respectively offset relative to one another by 120 degrees, wherein depending on the switching direction this can be brought into engagement with actuating rollers, which are arranged at a rocker of the movable permanent main contact, in order to thus pivot the permanent main contact in its respective end position in such a manner that the respective resiliently articulated multiple contact blades of the corresponding fixed permanent main contact are connected purely by pressure. In addition, the actuating rollers during the complete changeover process run with easy motion along the outer end face of the respective drive disk in contact-making manner. Thus, there takes place not a frictional blocking in a middle setting, but a light continuous movement at the end face profile of the respective drive disk.

According to a preferred form of embodiment f the invention the rail-shaped movable permanent main contact is is constructed to be exchangeable. As a result, in the case of contact wear a simple possibility is created of servicing or replacing the rail-shaped movable permanent main contact.

BRIEF DESCRIPTION OF THE DRAWING

The invention shall be explained in more detail by way of example in the following on the basis of drawings, in which.

SPECIFIC DESCRIPTION OF THE DRAWING

Figure 1:
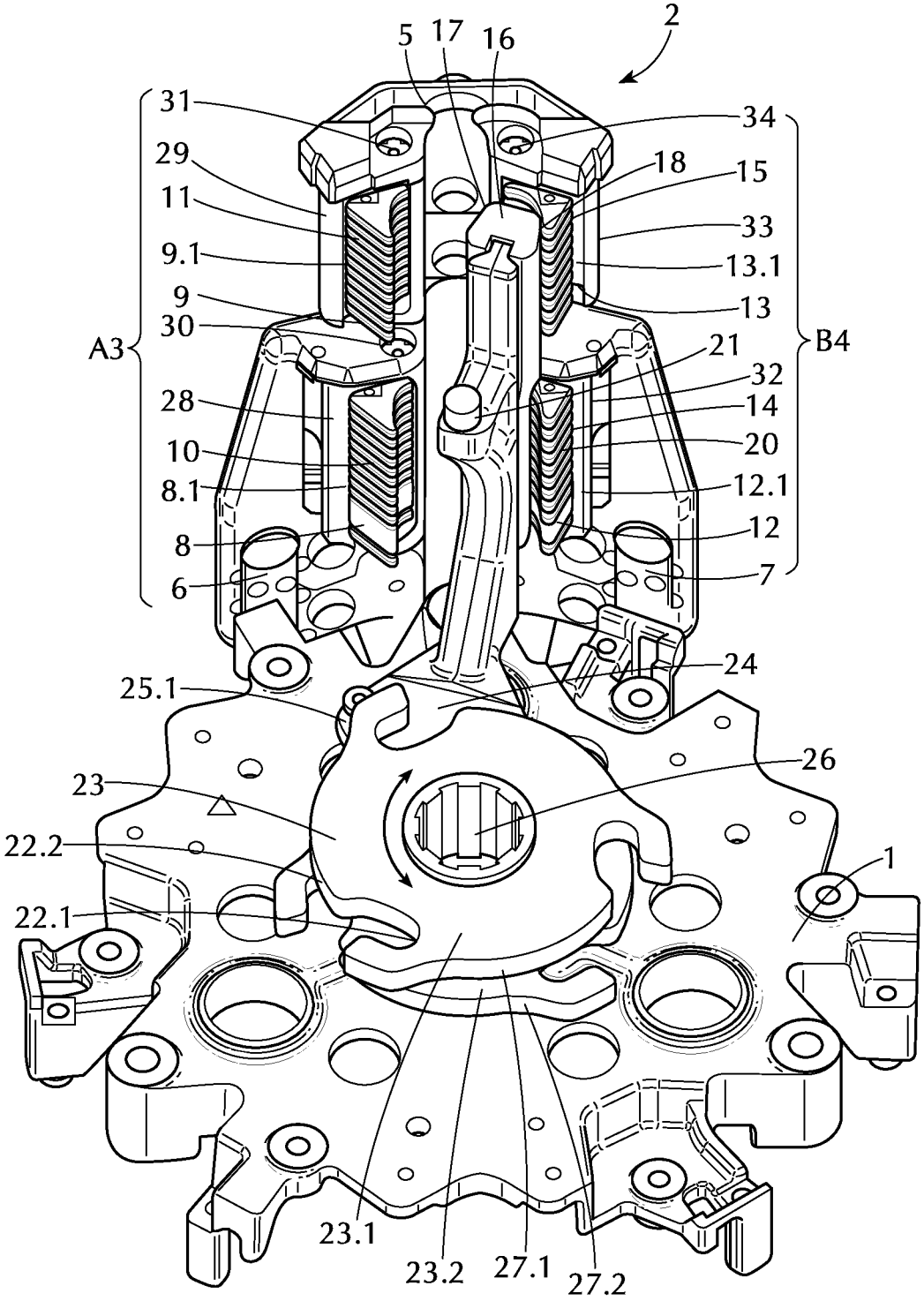
FIG. 1 shows a load changeover switch according to the invention with permanent main contacts in schematic, perspective illustration, wherein for reasons of improved clarity a number of components and switching means, which are not absolutely necessary for explanation of the invention, have been omitted.

The supporting element of the load changeover switch is a base plate 1, which for each phase receives and carries the movable permanent main contacts and the means for actuation thereof. Only one such complete permanent main contact 2 is illustrated here. Fixed permanent main contact pairs 3, 4 co-operating therewith are fastened to the inner wall of an oil vessel, which is not illustrated and which encloses the entire load changeover switch. For that purpose, three contact carriers 5, 6, 7 are provided for each phase. Arranged at the lefthand side are the first fixed permanent main contact pair 3, consisting of fixed first permanent main contacts 8, which are arranged at the bottom and electrically connected with a side A of the load changeover switch, and fixed second permanent main contacts 9, which are arranged thereabove and lead to the common load shunt of the load changeover switch. It can be seen that each of the fixed permanent main contacts 8 and 9 consists of a plurality of individual contact blades 8.1 and 9.1, respectively. Each of the contact blades 8.1 and 9.1 is fastened to a spring rocker 28 or 29, which is mounted to be resiliently rotatable about an axle 30 or 31, respectively. The contact blades 8.1 and 9.1 are in turn resiliently articulated to the respective spring rocker 28 or 29 by means of contact springs 10 or 11, which are merely indicated. Disposed on the right-hand side is the second fixed permanent main contact pair 4. This consists, entirely analogously, of fixed first permanent main contacts 12, which are arranged at the bottom and electrically connected with the other side B of the load changeover switch, and fixed second permanent main contacts 13, which are arranged thereabove and lead to the common load shunt. In this case as well each of the fixed permanent main contacts 12 and 13 is consisting of a plurality of individual contact blades 12.1 or 13.1, respectively, which—again entirely analogously—are individually resiliently articulated by contact springs 14 and 15 (shown only schematically) to spring rockers 32 and 33, respectively, which in turn are mounted to be rotatable about an axle 34 and an axle 35 which is not visible in this illustration. The fixed permanent main contacts 9 and 13 are arranged on a first electrically conductive contact carrier 5 and form the common load shunt. The fixed permanent main contacts 8 are arranged on the second contact carrier 6 and connected with the side A of the load changeover switch, and the fixed permanent main contacts 12 are, electrically insulated therefrom, arranged on the third contact carrier 7 and connected with the side B of the load changeover switch.

In addition, a common electrically conductive movable permanent main contact 16 constructed as a contact rail is provided. It has in the upper region at its lefthand side a run-up surface 17, which corresponds with the fixed permanent main contacts 9, as well as on its right-hand side a run-up surface 18, which corresponds with the fixed permanent contacts 13. In its lower region it has on the lefthand side a contact surface 19, which cannot be seen in this illustration and which corresponds with the fixed permanent main contacts 8, as well as on the right-hand side entirely analogously a further contact surface 20, which in turn corresponds with the fixed permanent main contacts 12. The movable rail-shaped permanent main contact 16 additionally has a bearing 21 which so co-operates with a mount (not illustrated in more detail) that the movable permanent main contact 16 is pivotable in the longitudinal axis of the load changeover switch about the bearing 21. A more precise description of the pivoting process of the permanent main contact 16 is present in the explanations with respect to FIG. 2.

The two run-up surfaces 17 and 18 are in that case not-as in accordance with the prior art—spherically dimensioned so that during pivoting of the movable permanent main contact 16 about the bearing 21 thereof they would remain in constant contact with the is fixed permanent main contacts 9 and 13, but are of rectilinear rail-shaped form in such a manner that they come into contact with the respectively corresponding fixed permanent main contacts 9 or 13 only on pivoting of the movable permanent main contact 16 into one of its two end positions. In that case, during the actual changeover process of the movable permanent main contact 16 a complete electrical separation between the two first permanent main contacts 8 and 12 and the respectively corresponding upper second permanent main contacts 9 and 13 takes place. In other words: there is thus indeed no permanent electrical connection of the movable permanent main contact 16 with the load shunt during the actual changeover process. The guidance in terms of potential during pivoting of the permanent main contact 16 takes over a constant connection, which cannot be seen in this illustration, with the load shunt.

The actuation of the pivotable permanent main contact 16 takes place by means of a drive disk 23, which consists of two individual disks 23.1 and 23.2 and which has roller engagements 22.1 and 22.2 respectively offset relative to one another by 120 degrees, wherein depending on the switching direction these can be brought into engagement with actuating rollers 25.1 and 25.2, which are arranged at the respective side of a rocker 24 of the movable permanent main contact 16, in order to thereby so pivot the permanent main contact 16 about its bearing 21 into its respective end position that the respective resiliently articulated multiple contact blades of the corresponding fixed permanent main contact are connected purely by pressure. The upper actuating roller 25.1 in that case cooperates with the upper drive disk 23.1, whereagainst the lower actuating roller 25.2, which is not visible in this illustration, can be brought into engagement with the roller engagements 23 of the lower drive disk 23.2. In addition, the actuating rollers 25.1 and 25.2 run along during the complete changeover process with easy motion along corresponding outer end faces 27.1 and 27.2, respectively, of the respective drive disk 23.1 or 23.2 in contact-making manner and through these constrained guidances effect a defined movement of the movable permanent main contact 16 which is produced over the corresponding end-face profile 27.1 or 27.2 of the drive disk 23.1 or 23.2 and is dependent on the switching sequence of the changeover process. According to the invention, thus no purely frictional blocking in a middle setting takes place, but a light continuous motion of the movable permanent main contact 16 by means of the actuating roller 25.1 or 25.2 at the corresponding end-face profile 27.1 or 27.2 of the respective drive disk 23.1 or 23.2. In addition, provided in the drive disk 23 is a central opening 26 in which a drive shaft (shown in section at 36 only in FIG. 2*a*) of the load changeover switch engages and exerts on the drive disk 23 a rotational movement in the case of a changeover process.

Figure 2A:
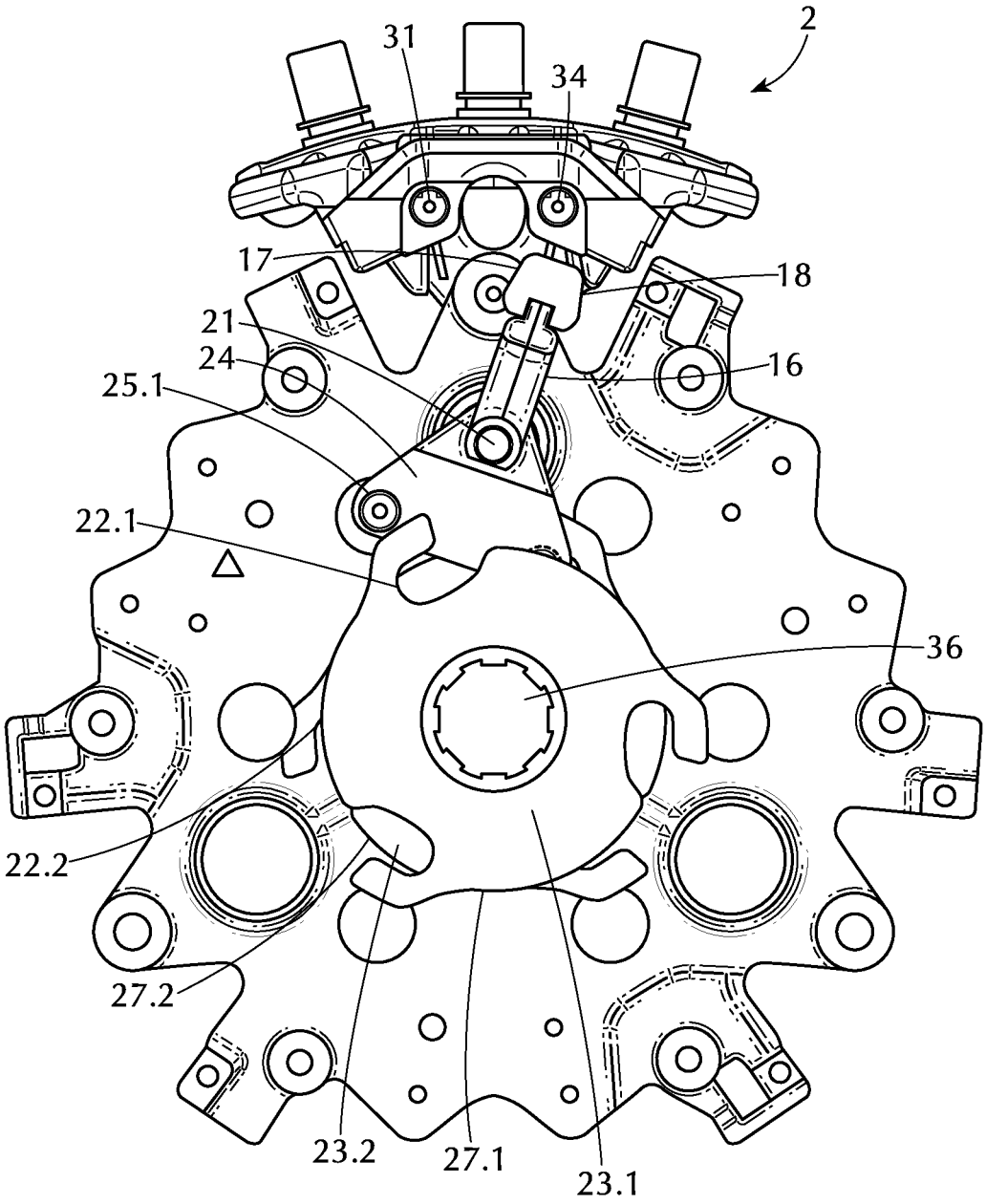
FIGS. 2*a* to 2*c* show a similarly schematic sectional illustration of a load changeover switch according to the invention with permanent main contacts in different switch settings.
Figure 2B:
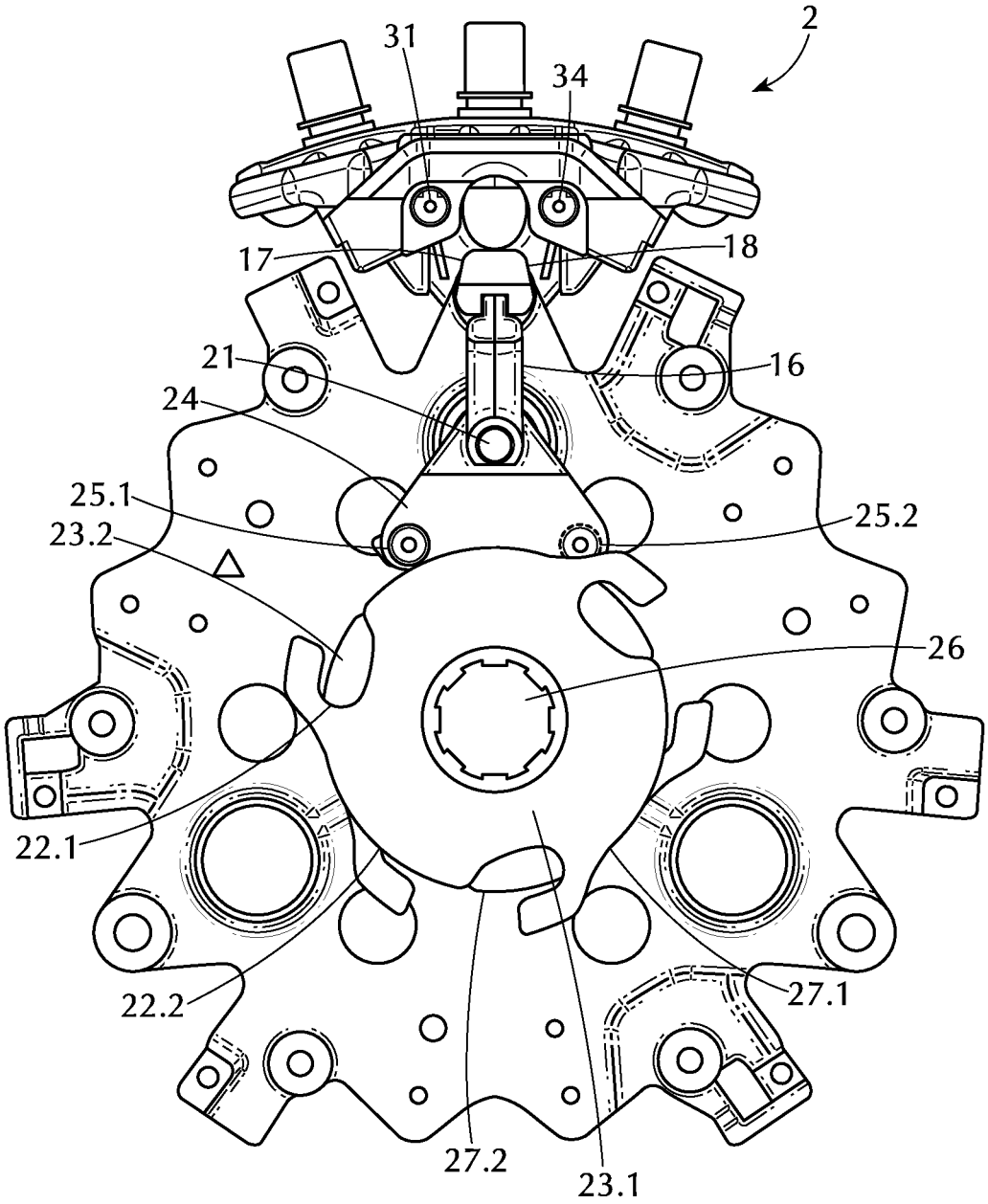
Figure 2C:
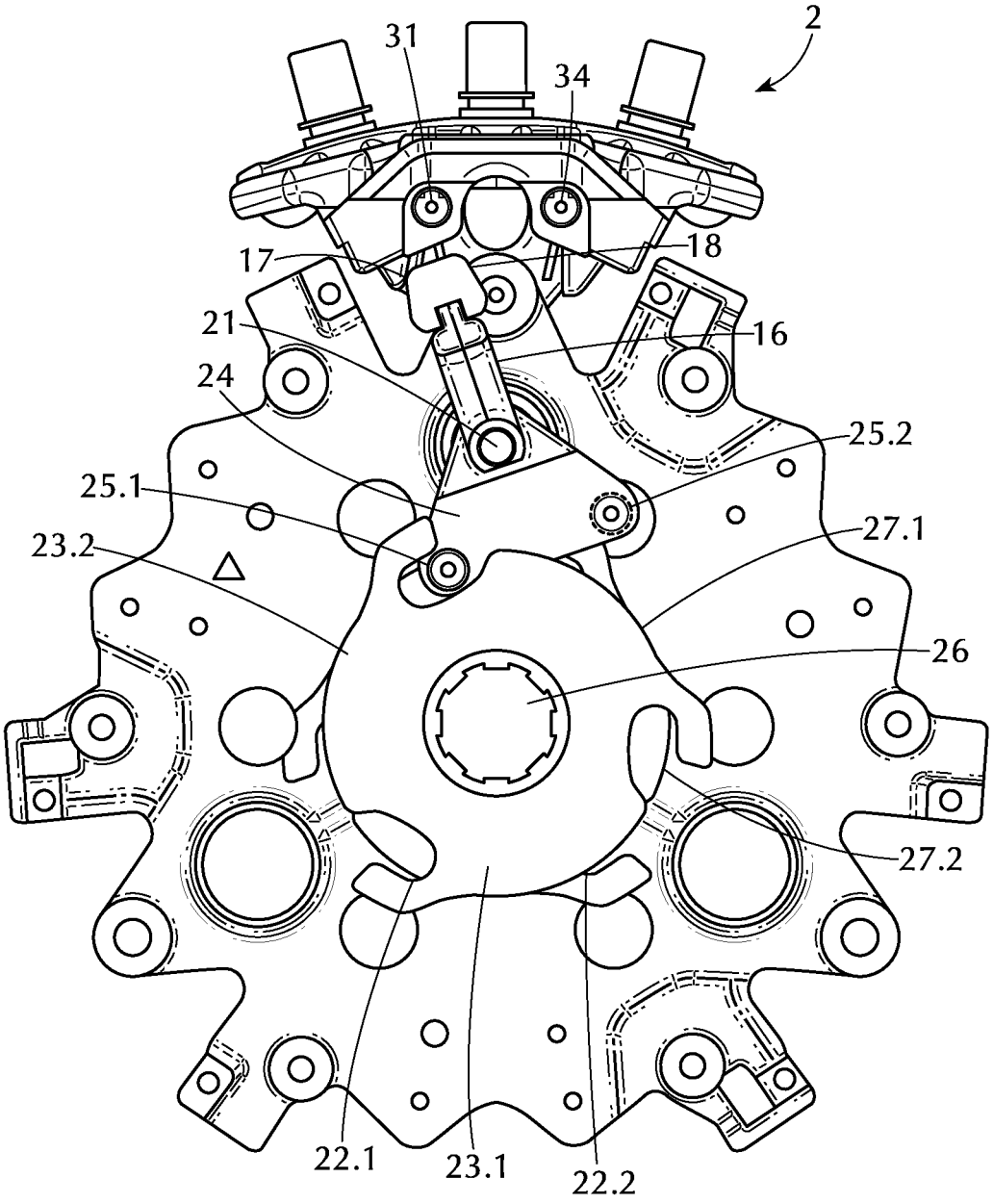

FIGS. 2*a* to 2*c* show the plan view of a load changeover switch according to the invention with permanent main contacts in different switch settings of a changeover process from the connected side B to the side A of the load changeover switch. In that case, the stationary state of the connection of the side B of the load changeover switch is shown in FIG. 2*a*, in which the run-up is surface 18 of the movable permanent main contact 16 is firmly pressed by means of the roller engagements 22.2 of the lower drive disk 23.2 and the corresponding actuating roller 25.2 at the lower side of the rocker 24 against the corresponding contact blades 12.1 or 13.1 of the fixed permanent main contacts 12 or 13. In these end positions as well the actuating roller 25.1 does not leave the end-face profile 27.1 of the upper drive disk 23.1. In addition, according to the invention a large dielectric spacing between the run-up surface 17 of the movable contact 16 and the corresponding contact blades 8.1 or 9.1 of the fixed permanent main contacts 8.

In FIG. 2*b* the movable contact 16 is pivoted about its bearing 21 into the middle setting and in that case is not electrically connected with any of the fixed permanent main contacts 12 of the side B. the fixed permanent main contacts 8 of the side A and the fixed permanent main contacts 9 or 13 of the load shunt. Moreover, the upper actuating roller 25.1 in that case rolls along the end-face profile 27.1 of the upper drive disk 23.1, whereagainst the lower actuating roller 25.2 rolls on the end-face profile 27.2 of the lower drive disk 23.2. A particularly low-friction blocking of the movable permanent main contact 16 in the middle setting thereby takes place.

FIG. 2C shows the connection of the side A of the on-load tap changer in the stationary state after a complete changeover process. In that case the run-up surface 17 of the movable permanent main contact 16 is pressed by means of the roller engagements 22.1 of the upper drive disk 23.1 and the corresponding actuating roller 25.1 at the upper side of the rocker 24 firmly against the corresponding contact blades 8.1 or 9.1 of the fixed permanent main contacts 8 or 9. In this end position as well the actuating roller 25.2 does not leave the end-face profile 27.2 of the lower drive disk 23.2.

The invention claimed is:

1. A load changeover switch for a tap changer, wherein each phase to be switched has two fixed permanent main contact pairs that can be bridged by a single movable electrically-conductive permanent main contact pivotable into two different end settings, in each phase to be switched a respective one of the permanent main contact pairs is bridged over the stationary state and conducts the permanent current in such a manner that at the start of a load changeover the permanent main contact pair previously conducting the permanent current opens and at the end of each load changeover the previously open other permanent main contact pair is bridged over and takes over the permanent current, a centrally extending switching shaft by which the movable permanent main contact is actuatable is arranged in the interior of the load changeover switch, each of the two permanent main contact pairs respectively consists of a first permanent main contact pair and a second permanent main contact pair electrically insulated therefrom, one of the first permanent main contacts is connected with side A and the other one of the first permanent main contacts is connected with the second side B of the load changeover switch, the two second permanent main contacts are electrically connected with a common load shunt of the load changeover switch, the movable permanent main contact is of rail-shaped and constructed in such a manner as to be electrically connected only in the respective end positions thereof with the permanent main contacts of the load shunt, and a drive disk consisting of two individual disks is provided that has roller engagements offset relative to one another through 120° and that depending on the switching direction can be so brought into engagement with actuating rollers at a rocker of the movable permanent main contact that the movable rail-shaped permanent main contact is actuatable by only a single deflection.

2. The load changeover switch according to claim 1, wherein the movable rail-shaped permanent main contact is exchangeable.

3. The load changeover switch according to claim 1, wherein each of the fixed permanent main contacts consists of a plurality of individual contact blades.

4. The load changeover switch according to claim 3, wherein each of the contact blades is fastened to a respective spring rocker mounted to be resiliently rotatable about an axle and the contact blades are in turn resiliently articulated to the spring rockers by contact springs.

* * * * *